US008175309B2

(12) United States Patent
Hanisch et al.

(10) Patent No.: US 8,175,309 B2
(45) Date of Patent: May 8, 2012

(54) HEARING AID DEVICE

(75) Inventors: Michael Hanisch, Erlangen (DE); Benjamin Schmidt, Nürnberg (DE); Erwin Singer, Eckental (DE); Roland Weigert, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 862 days.

(21) Appl. No.: 12/231,407

(22) Filed: Sep. 2, 2008

(65) Prior Publication Data

US 2009/0067655 A1 Mar. 12, 2009

(30) Foreign Application Priority Data

Sep. 7, 2007 (DE) ..... 10 2007 042 591

(51) Int. Cl.
*H04R 25/00* (2006.01)

(52) U.S. Cl. ..... 381/329; 381/322

(58) Field of Classification Search ..... 381/322, 381/323, 324, 328
See application file for complete search history.

(56) References Cited

U.S. PATENT DOCUMENTS

| | | | | |
|---|---|---|---|---|
| 6,310,960 | B1 * | 10/2001 | Saaski et al. | 381/323 |
| 6,584,207 | B1 * | 6/2003 | Yoest et al. | 381/322 |
| 7,508,951 | B2 * | 3/2009 | Bordewijk | 381/329 |
| 2001/0040973 | A1 | 11/2001 | Fritz et al. | |

FOREIGN PATENT DOCUMENTS

DE 2459259 7/1975

* cited by examiner

*Primary Examiner* — Davetta W Goins
*Assistant Examiner* — Amir Etesam

(57) ABSTRACT

The invention relates to a hearing aid device, in particular a hearing aid, preferably an in-the-ear hearing aid, with a long-stretched out removal device and a guide for the removal device, wherein the guide is embodied on or within the hearing aid device and the removal device is accommodated displaceably in the guide. The invention further relates to a hearing aid device set, in particular an in-the-ear hearing aid set, with a hearing aid device according to the invention and an electrical recharging device.

20 Claims, 2 Drawing Sheets

HEARING AID DEVICE

CROSS REFERENCE TO RELATED APPLICATIONS

This application claims priority of German application No. 10 2007 042 591.2 filed Sep. 7, 2007, which is incorporated by reference herein in its entirety.

FIELD OF THE INVENTION

The invention relates to a hearing aid device, in particular a hearing aid, preferably an in-the-ear hearing aid (ITE). The invention further relates to a hearing aid device set, in particular an in-the-ear hearing aid set with an electrical recharging device and a hearing aid device according to the invention.

BACKGROUND OF THE INVENTION

In order to accommodate the aesthetic needs of a wearer of a hearing aid device, such devices should be as inconspicuous as possible externally on a wearer. Therefore a necessary miniaturization of the hearing aid devices on the one hand, and their optimally diverse range of functions together with high-quality processing, within the hearing aid devices, of the signals that are necessary for improving hearing ability on the other represent opposing requirements.

In addition, the adaptation of hearing aid devices to different types of hearing damage by different power levels and users' demands for the smallest possible designs are forcing manufactures to offer a wide range of hearing aid devices with different sizes for different power ranges.

For reasons of environmental protection and the significant increase in the electrical storage capacity of batteries in recent years, nowadays increasing numbers of hearing aids and hearing aid devices with rechargeable batteries or a rechargeable battery cell are available on the market. These are replacing the previously common zinc-air batteries.

Batteries are in particular suitable for hearing aids with a lower power, such as those used, for example, to improve mild hearing damage and/or with a comparatively small range of functions. It is obviously also possible to use batteries in hearing aid devices with a high amplifier power and/or a wide range of functions. Hereby, it is then preferable to use a plurality of hearing aid devices or a plurality of batteries on an exchange basis.

In particular with ITEs, the requirements relating to miniaturization, the range of functions, amplifier power and battery capacity are particularly high. These rechargeable ITEs are provided with charging contacts for a charger on an identical cover plate for all ITEs of a specific range—which is generally called the faceplate. This is based on the fact that a side of the ITE opposite the cover plate has an otoplastic which has been individually adapted for the hearing aid wearer.

Due to the individual otoplastic design, it makes no sense to attach the charging contacts for the battery on this side of the ITE since then it would generally be necessary also to produce an individually adapted charging cradle for an electrical recharging device. Therefore, in order to be able to operate a plurality of ITEs with a single electrical recharging device, it is necessary to provide the charging contacts on the cover plate.

To remove relatively small ITEs from an ear or an auditory canal of the hearing aid wearer, they have a small thread which may be gripped by the finger of the hearing aid wearer.

This thread—also called an extraction or drawing thread—is attached, generally glued, to the side of the cover plate.

In the case of a rechargeable ITE with charging contacts on the side of the cover plate, this thread would be in the way when the ITE is inserted into the charger or in the charging cradle of the charger. In addition, in particular in the case of larger hearing aid devices, such as is the case, for example, with a concha hearing aid device, a thread of this kind can impair the overall aesthetic impression of the hearing aid device.

In addition to the fixed extraction threads known from the prior art, the hearing aid can also be held on an open battery door and pulled out of the human ear thereby.

SUMMARY OF THE INVENTION

It is therefore an object of the invention to provide an improved hearing aid device, in particular an improved hearing aid, preferably an improved in-the-ear hearing aid (ITE). In addition, it is an object of the invention, to provide a corresponding hearing aid device set, in particular a corresponding in-the-ear hearing aid set which comprises an electrical recharging device and a hearing aid device according to the invention.

The invention should in particular make it possible to provide a rechargeable hearing aid device in which a removal device (extraction thread) impairs the insertion of the hearing aid device in an electrical recharging device or a charging cradle of the recharging device to the lowest possible degree. In addition, with larger hearing aid devices, such as, for example, a concha hearing aid device, the overall aesthetic impression of the hearing aid device should be impaired to lowest possible degree by a removal device of this kind.

The object of the invention is achieved by a hearing aid device, in particular a hearing aid, preferably an in-the-ear hearing aid and a hearing aid device set, in particular an in-the-ear hearing aid set according to the claims.

In one embodiment of the invention, the hearing aid device has a removal device which is accommodated in a guide of the hearing aid device in such a way that it can be moved back and forth. In another embodiment of the invention, the hearing aid device has a long-stretched out removal device, which is provided in a guide of the hearing aid device and accommodated in the guide in a linearly movable manner.

In principal, there are two embodiments of the invention, which in turn are divided into two basic embodiments.

On the one hand, it is possible for the removal device to pass completely through the hearing aid device. This enables the removal device to protrude or project on two sides, preferably on two sides which are directly opposite each other, of the hearing aid device. On the other hand, it is possible for the removal device to be inserted into the hearing aid device. In a completely inserted condition, the removal device is more or less completely accommodated within the hearing aid device. In a completely pulled out condition, the removal device is virtually completely pulled out of the hearing aid device.

With these two embodiments of the invention, it is now possible to embody the guide completely within the hearing aid device, for example as a drill hole (through hole or blind hole) from the outside or as a recess (blind hole which is at least partially open on the longitudinal side, through recess or groove) on the hearing aid device, wherein the removal device is provided in an external edge area of the hearing aid device. To make it impossible for the removal device to fall out or be removed from a lateral opening on the hearing aid device, this recess has a cross section with an undercut. This produces an opening on the hearing aid device which is narrower than the greatest thickness of the removal device.

According to the invention, depending on the situation (aesthetic appearance when wearing, when removing the hearing aid device from the ear and when it is being charged), the movable removal device is in the position desired by the hearing aid wearer or the correct position. When the hearing aid device is being worn or removed, the removal device is extended and the hearing aid device can be removed from the human ear. When the hearing aid is not being worn or is being charged, the removal device of the hearing aid device is retracted or stands to one side of the otoplastic and enables charging in a charging cradle of an electrical recharging device.

In addition, with one embodiment of the invention, in which the removal device in retracted condition is accommodated virtually completely within the hearing aid, this can correspond to the condition when the hearing aid device is being worn in order to satisfy the aesthetic requirements of the wearer, who will not necessarily want the removal device to protrude outward, i.e. from the cover plate and hence the ear, when the hearing aid is being worn.

According to the invention, the removal device is not fixed in the hearing aid device but can be moved forward and backward through the guide in the hearing aid device. A frontal position of the guide going from the cover plate into the hearing aid device is optional depending upon the circumstances (auditory canal, available space within the hearing aid).

In preferred embodiments of the invention, the removal device has a thickening on one but preferably on both longitudinal ends in order make it easier to grip the removal device with two fingers. In addition, a thickening of this kind serves to hold the removal device in the guide in extended or retracted condition.

Preferably, for the respective extended or retracted condition of the removal device, the hearing aid device has on its relevant external side an indentation for the thickening. Hereby, the indentation is preferably embodied in such a way that it is able to accommodate the thickening at least partially, but preferably completely.

In a preferred embodiment of the invention, the guide for the removal device passes completely through the hearing aid device. Hereby, preferably an indentation is provided on each of the two opposing openings of the guide on the hearing aid device. Preferably, hereby the guide has a diameter which substantially corresponds to a diameter of the removal device in its central region.

In other preferred embodiments of the invention, a longitudinal end portion of the removal device with a variable length is accommodated in any position within the hearing aid device. Hereby, this longitudinal end portion accommodated within the hearing aid device can be accommodated within the hearing aid device substantially with its complete length or only with a comparatively short longitudinal end portion (thickening, see below). All intermediate stages thereof are possible, that is with embodiments of this kind, the removal device can be inserted from its extended condition completely or virtually completely in the hearing aid device.

With embodiments of the invention of this kind, it is preferable that the longitudinal end of the removal device arranged within the hearing aid device has a thickening, which, in combination with a bolt in the region of the opening of the guide on the hearing aid device, prevents the removal device from being completely pulled out of the hearing aid device.

With preferred embodiments of the invention, the guide is provided within or on the hearing aid device in such a way that it lies to the side of a region of the hearing aid device which may be placed in the region of an auditory canal. Hereby, this auditory canal region should correspond to a region of the hearing aid device which can be substantially in alignment with the auditory canal of the hearing aid wearer in question. Preferably, this also includes regions of the hearing aid device provided in the vicinity of the part of the hearing aid device in alignment with the auditory canal.

The hearing aid device set according to the invention has a hearing aid device according to the invention and an electrical recharging device. To charge the hearing aid device, it and its cover plate are placed on a charging cradle of the electrical recharging device or inserted therein.

Hereby, instead of the hearing aid device, the charging cradle can have a recess for a thickening of a removal device of the hearing aid device. In addition, it is preferable for the recess of the charging cradle for the thickening of the removal device to be substantially dimensioned in such a way that the thickening can be completely accommodated therein. However, it is also possible to provide recesses corresponding to each other in the charging cradle and in the hearing aid device in such a way that they can accommodate the thickening together.

According to the invention, on the insertion of the hearing aid device in the charging cradle, the removal device is pushed into the hearing aid device or through it so that the removal device is either virtually completely accommodated within the hearing aid device or emerges therefrom again at one side of the otoplastic. The charging contacts of the cover plate can then be electrically contacted by the electrical recharging device.

When the hearing aid device is inserted in a human ear or an auditory canal, unless the removal device was previously manually brought into the condition when the hearing aid device is being worn or removed, it is pushed out again by a projection in the ear or on the auditory canal, so that the removal device protrudes on the side of the cover plate thus enabling the hearing aid device to be removed comfortably later.

According to the invention, despite the removal device, the insertion of an electrically rechargeable hearing aid device in the charging cradle or the electrical recharging device is not impeded. The removal device required for the hearing aid device is no longer a restriction since the removal device is provided displaceably in the hearing aid device.

It is an advantage of the invention that the hearing aid wearer does not have to pay attention to the handling of the removal device. When the hearing aid device is inserted in the auditory canal, the removal device is pushed out and, on the other hand, when the hearing aid device is inserted in a charging device, the removal device is pushed into the hearing aid device or through it in the direction of the otoplastic.

Further embodiments of the invention may be found in the other, dependent, claims.

BRIEF DESCRIPTION OF THE DRAWINGS

The invention will now be explained in more detail below with reference to exemplary embodiments and the attached drawings which show.

DETAILED DESCRIPTION OF THE INVENTION

Figure 1:
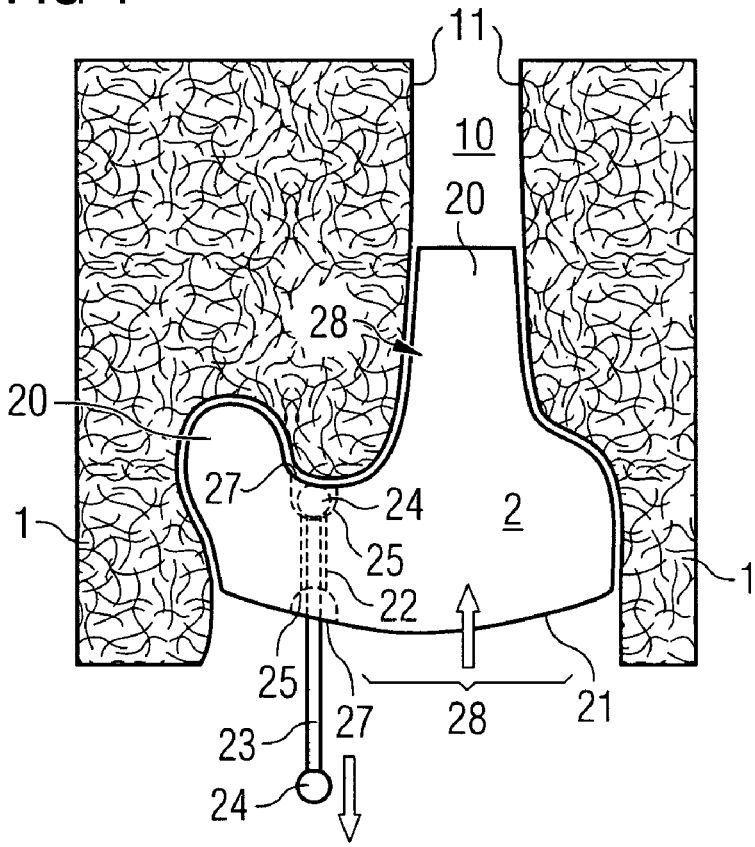
FIG. 1 in a cut-off top view, the insertion of a hearing aid device according to the invention in an auditory canal of a human ear FIG. 2 in a cut-off side view, the insertion of the hearing aid device according to the invention in FIG. 1 in a charging cradle of an electrical recharging device FIG. 3 in a cut-off top view, a schematic representation of a further embodiment of the hearing aid device according to the invention.

The invention will be described below with reference to an in-the-ear hearing aid (ITE). Hereby, the drawing shows a so-called ITE hearing aid device (in-the-ear). However, it is not intended to restrict the invention to embodiments of this kind; it also covers ITC-hearing aid devices (in-the-canal), CIC-hearing aid devices (complete-in-canal), concha and auditory canal-hearing aid devices. In particular, the invention relates hereby to hearing aids.

FIG. 1 shows an ITE 2 on or directly after insertion in a human ear 1. Hereby, an auditory canal region 28 of the ITE 2 protrudes into an auditory canal 10 or an external auditory canal 10 of the human ear 1. A portion of the auditory canal region 28 is formed by an otoplastic 20 of the ITE 2 which has been individually adapted to the human ear 1.

The otoplastic 20 lies opposite a cover plate 21, which, as a rule, is identical for all ITEs 2 of a range or for all ITEs 2 of several ranges and therefore does not have to be individually adapted to a wearer of the ITE 2. When the ITE 2 is being worn, the otoplastic 20 sits partially on an auditory canal wall 11 and on the concha of the human ear 1.

The ITE 2 has a removal device 23 which is displaceable or can be moved back and forth and which in FIG. 1 protrudes from the cover plate 21 of the ITE 2 in its so-called extended condition. This removal device 23 extending through the ITE 2 can be used to remove or detach the ITE 2 from the ear 1. In addition, the ITE 2 can be inserted in the ear 1 by means of the removal device 23.

Figure 2:
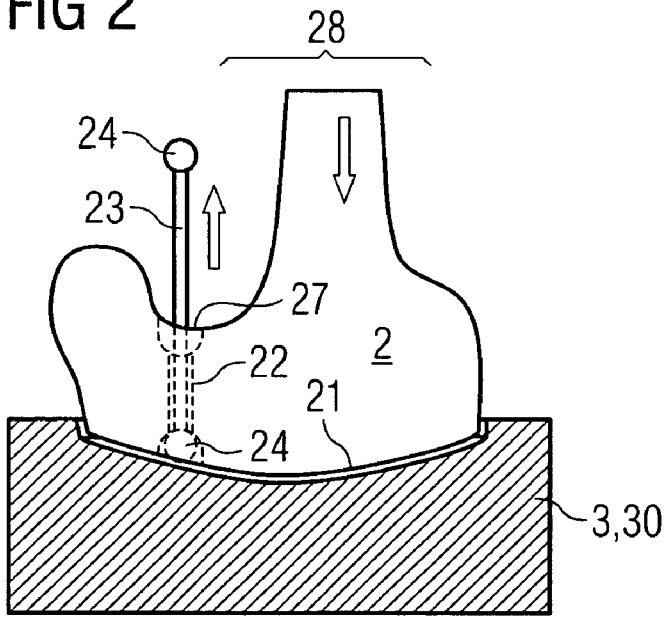

FIG. 2 shows the ITE 2 during the charging of a battery accommodated within the ITE 2 (not shown in the drawing). Here, the ITE 2 is inserted with its cover plate 21 in a charging cradle 30 of an electrical recharging device 3. In this charging condition shown in FIG. 2, the removal device 23 is in its retracted condition and now no longer protrudes from the cover plate 21, but from the ITE 2 in the region of the otoplastic 20.

Therefore, the removal device 23 according to the invention is guided movably or displaceably within or on the ITE 2; according to the invention, it is mounted in a sliding manner on or in the ITE 2. According to the invention, the removal device 23 can move back and forth between its extended condition (removal and/or wearing condition) and its retracted charging condition. This is illustrated by the respective arrows in FIGS. 1 and 2.

Starting from the retracted condition (FIG. 2) of the removal device 23, the extended condition shown in FIG. 1 is adopted. Hereby, on the insertion of the ITE 2 in the human ear 1, the removal device 23 is extended, that is brought by a projection on the ear 1 or the auditory canal 10 into the extended condition; although, this can also be performed manually, for example by means of a finger. This is indicated by the arrows in FIG. 1.

Vice versa, if the ITE 2 is pulled out by means of the removal device 23, the ITE 2 can be removed from the human ear 1 and then placed on the charging cradle 30. Hereby, the ITE 2 is moved toward the charging cradle 30, wherein firstly the removal device 23 comes into contact with the charging cradle 30 and after the further movement of the ITE 2 toward the charging cradle 30, the removal device 23 adopts its retracted condition. This can also be performed manually (see above) before the insertion of the ITE 2 in the charging cradle 30.

To enable the removal device 23 to move back and forth between its extended (FIG. 1) and its retracted (FIG. 2) condition, it is guided on or within the ITE 2. This is performed by means of a guide 22, which is embodied as a drill hole 22 or through hole 22 in the ITE 2 in the exemplary embodiment shown in FIGS. 1 and 2.

The diameter of the drill hole 22 is slightly larger than a diameter of the removal device 23 in a center portion. Preferably, hereby the removal device 23 is a drawing thread 23, an extraction thread 23, a thread 23, a little rod 23 or a rod 23. Preferably, the removal device 23 is made of plastic or a metal or a metal alloy.

To ensure that in the present exemplary embodiment, the removal device 23 cannot be completely removed from the ITE 2, at one longitudinal end, but preferably at both longitudinal ends, it has a thickening 24. This thickening can for example be embodied as a sphere, a bead or a portion of any shape or a finger grip. It is only necessary to ensure that the largest diameter of the thickening 24 is larger than the smallest diameter of the guide 22.

In the region of an opening 27, at which the guide 22 protrudes on an external side of the ITE 2 or externally in a region around the guide 22, the ITE 2 preferably has an indentation 25. Preferably, the ITE 2 has an indentation 25 of this kind in the region of both openings 27 of the guide 22 on the ITE 2. The relevant thickening 24 of the removal device 23 can be accommodated at least partially, but preferably more or less completely in the respective indentation 25. This is easily identifiable in the extended condition of the removal device 23 in FIG. 1 and in the retracted condition of the removal device 23 in FIG. 2. Hereby, the respective thickening 24 is substantially completely accommodated in the respective indentation 24.

According to the invention, the removal device 23 is guided linearly or substantially in a linearly movable manner in the ITE 2. Depending upon the deformability of the removal device 23, in particular when it is embodied as a sufficiently rigid thread 23, it is also possible to guide the removal device 23 on a curved path within the ITE 2 (see also below). This enables, for example, the optional selection of a retracted and an extended position of the removal device 23 on the ITE 2 within certain limits.

Figure 3:
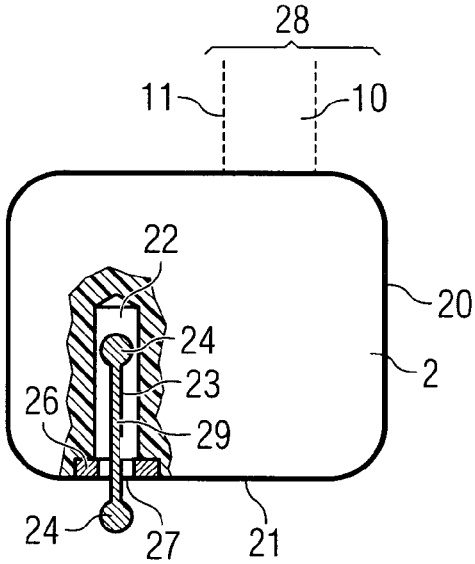
Figure 4:
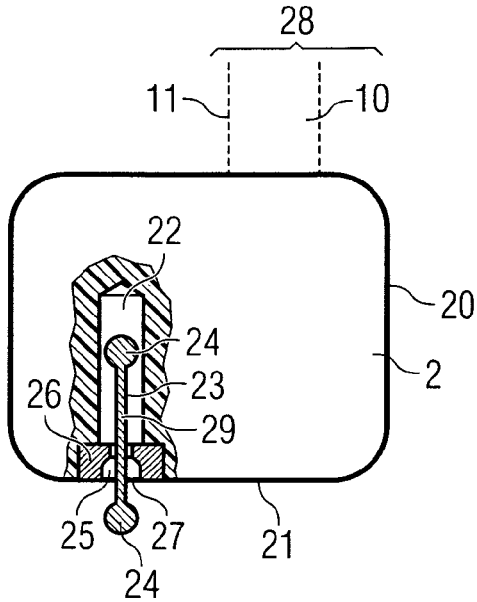
FIG. 4 an expanded embodiment of the hearing aid device according to the invention compared to FIG. 3

FIGS. 3 and 4 show two embodiments of the invention, in which the removal device 23 in the retracted condition no longer protrudes or projects from the ITE 2 or its otoplastic 20 but is completely accommodated within the ITE 2. This means, an internal longitudinal end portion 29 with a variable length of the removal device 23 is always accommodated within the ITE 2. Hereby, the removal device 23 is preferably embodied as in the exemplary embodiment in FIGS. 1 and 2.

Hereby, care must be taken to ensure that the guide 22, which is embodied in the present exemplary embodiment as a drill hole 22 or blind hole 22 has a slightly larger diameter than an external diameter of the thickening 24 within the ITE 2.

To prevent the removal device 23 from being completely pulled out of the ITE 2, in the region of the opening 27 it has a bolt 26 which reduces the diameter of the guide 22. This makes it possible on the one hand not to pull the removal device 23 completely out of the ITE 2. On the other hand, the thickening 24 opposite the internal thickening 24 makes it possible not to allow the removal device 23 to disappear completely within the ITE 2.

FIG. 4 now shows an expanded embodiment of the invention compared to that in FIG. 3, in which the bolt 26 now also has an indentation 25 in which the external thickening 24 of the removal device 23 can be at least partially, but preferably completely, accommodated.

As also with the embodiments of the invention according to FIGS. 1 and 2, once again the removal device 23 or its guide 22 is provided in a region of the ITE 2 lying to the side of the auditory canal region 28 of the ITE 2. Hereby, auditory canal region 28 should be understood to mean the region of the ITE 2 which is substantially surrounded by the auditory canal 10 of the human ear 1. This may also include directly adjacent regions of the ITE 2, i.e. in a case of this kind, the cross section of the auditory canal region of the ITE 2 is slightly larger than the relevant cross section of the auditory canal 10 of the hearing aid wearer 1.

With the embodiments of the invention according to FIGS. 3 and 4, it is in turn also possible for the removal device 23 to be not only substantially linearly movable in the ITE 2, but also for the removal device 23 to be partially or even completely movable on a curved path into the ITE 2. This obviously also applies to the embodiments of the invention according to FIGS. 1 and 2.

Figure 5:
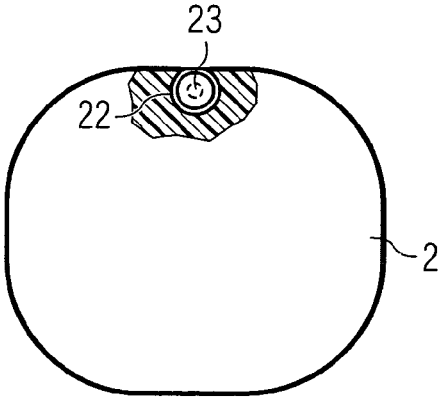
FIG. 5 in a cut-off side view, a schematic representation of a further embodiment of the hearing aid device according to the invention FIG. 6 a modified embodiment of the hearing aid device according to the invention compared to FIG. 5.
Figure 6:
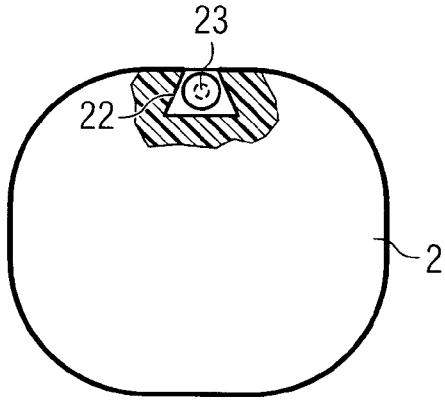

Unlike the previous examples of embodiments, FIGS. 5 and 6 now show a guide 22 embodied not as a drill hole 22, but as a recess 22 on an external region of the ITE 2. Hereby, the recess 22 is visible on the outside of the ITE 2. This means access to the guide 22 is possible not only in the region of the relevant opening 27, but also at least partially along the guide 22.

In FIG. 5, the guide 22 is embodied as a recess 22 which is at least partially open in its longitudinal direction whereby its cross section is a circular segment or a circular portion. A circular sector bounded by this circular segment hereby has an overlap angle of more than 180°. This means the cross section has an undercut so that the removal device 23 provided within the guide 22 is unable to fall out.

FIG. 6 shows now a guide 22 with a different cross section than that in FIG. 5, wherein this guide has a cross section with a swallowtail-shaped profile. Hereby, a width of the opening of the swallowtail-shaped profile on the ITE 2 is smaller than a maximum diameter of the removal device 23. This relates in particular to the thickening 24 on a longitudinal end of the removal device 23 within the ITE 2.

Reference is made to the fact that features of the invention according to FIGS. 1 to 4 are applicable to embodiments of the invention according to FIGS. 5 and 6, and features of invention according to FIGS. 5 and 6 are applicable to embodiments of the invention according to FIGS. 1 to 4.

The invention claimed is:

1. A hearing aid device having a cover plate and an opposed otoplastic surface, comprising:

a guide which extends between the cover plate and the otoplastic surface; and a long-stretched out removal device that is displaceably accommodated in the guide wherein the removal device includes first and second ends and the removal device is moveable between a first position wherein the first end extends from the cover plate and a second position wherein the second end extends from the otoplastic surface.

2. The hearing aid device as claimed in claim 1, wherein the removal device moves linearly in the guide.

3. The hearing aid device as claimed in claim 1, wherein the guide is a through hole or a blind hole in the hearing aid device.

4. The hearing aid device as claimed in claim 1, wherein the guide is a recess, a through recess, or a groove in the hearing aid device comprising a cross section with an undercut.

5. The hearing aid device as claimed in claim 1, wherein the removal device is a drawing thread, an extraction thread, a thread, a little rod, or a rod.

6. The hearing aid device as claimed in claim 1, wherein the removal device comprises a thickening at a longitudinal end for preventing the removal device being fully pulled out of the hearing aid device, wherein the hearing aid device comprises an indentation for the thickening in an opening of the guide, and wherein the thickening is a sphere or a bead.

7. The hearing aid device as claimed in claim 6, wherein a diameter of the guide in a central region or to a side of the indentation is larger than a diameter of the removal device in a central region or to a side of the thickening.

8. The hearing aid device as claimed in claim 7, further comprising a bolt in the opening of the guide.

9. The hearing aid device as claimed in claim 8, wherein the indentation at the opening of the guide is dimensioned to at least partially accommodated the thickening.

10. The hearing aid device as claimed in claim 1, wherein the guide is a drill hole that completely penetrates the hearing aid device and the hearing aid device comprises an indentation on both openings of the guide.

11. The hearing aid device as claimed in claim 1, wherein an internal longitudinal end portion of the removal device is accommodated in a position of the removal device within the hearing aid device.

12. The hearing aid device as claimed in claim 1, wherein the guide is in a side of an auditory canal region of the hearing aid device.

13. The hearing aid device as claimed in claim 1, wherein the removal device is made of a material selected from the group consisting of: a metal, a metal alloy, and a plastic.

14. The hearing aid device as claimed in claim 1, wherein the hearing aid device is a rechargeable hearing aid device.

15. The hearing aid device as claimed in claim 1, wherein the hearing aid device is an in-the-ear hearing aid.

16. The hearing aid device as claimed in claim 1, wherein the removal device is extended and protrudes from a cover plate of the hearing aid device when the hearing aid device is being worn or removed.

17. The hearing aid device as claimed in claim 1, wherein the removal device is retracted and protrudes from an otoplastic of the hearing aid device or protrudes into the hearing aid device when the hearing aid device is being worn or not being worn or is being charged.

18. A hearing aid device set having a cover plate and an opposed otoplastic surface, comprising:

an electrical recharging device;

a guide which extends between the cover plate and the otoplastic surface; and a long-stretched out removal device that is displaceably accommodated in the guide wherein the removal device includes first and second ends and the removal device is moveable between a first position wherein the first end extends from the cover plate and a second position wherein the second end extends from the otoplastic surface.

19. The hearing aid device set as claimed in claim 18, wherein the removal device comprises a thickening and a charging cradle of the electrical recharging device comprises a recess for the thickening.

20. The hearing aid device set as claimed in claim 19, wherein the recess of the charging cradle is dimensioned to at least partially accommodated the thickening.

* * * * *